US005494635A

United States Patent [19]

Bennett

[11] Patent Number: 5,494,635

[45] **Date of Patent: *Feb. 27, 1996**

[54] STRATIFIED ENRICHED ZONES FORMED BY THE GAS PHASE CARBURIZATION AND THE SLOW COOLING OF CEMENTED CARBIDE SUBSTRATES, AND METHODS OF MANUFACTURE

[75] Inventor: Stephen L. Bennett, Rochester Hills, Mich.

[73] Assignee: Valenite Inc., Madison Heights, Mich.

[ * ] Notice: The term of this patent shall not extend beyond the expiration date of Pat. No. 5,310,605.

[21] Appl. No.: 64,686

[22] Filed: May 20, 1993

[51] Int. Cl.[6] ..... B22F 3/10; B22F 7/00

[52] U.S. Cl. ..... 419/14; 419/10; 419/18; 419/38; 419/57; 419/58; 428/547

[58] Field of Search ..... 419/10, 14, 18, 419/38, 57, 58; 428/547

[56] References Cited

U.S. PATENT DOCUMENTS

| | | | |
|---|---|---|---|
| 3,932,594 | 1/1976 | Gortsema | 423/440 |
| 4,225,344 | 9/1980 | Fujimori et al. | 75/203 |
| 4,579,713 | 4/1986 | Lueth | 419/58 |
| 4,591,481 | 5/1986 | Lueth | 419/26 |
| 4,610,931 | 9/1986 | Nemeth et al. | 428/547 |
| 4,639,352 | 1/1987 | Kodama et al. | 419/15 |
| 4,820,482 | 4/1989 | Fischer et al. | 419/15 |
| 4,830,930 | 5/1989 | Taniguchi et al. | 428/547 |
| 4,911,989 | 3/1990 | Minoru et al. | 428/547 |
| 5,041,261 | 8/1991 | Buljan et al. | 419/11 |
| 5,106,674 | 4/1992 | Okada et al. | 428/217 |
| 5,279,901 | 1/1994 | Akerman et al. | 428/469 |
| 5,310,605 | 5/1994 | Baldoni, II et al. | 428/569 |
| 5,338,506 | 8/1994 | Friederichs et al. | 419/44 |

FOREIGN PATENT DOCUMENTS

| | | |
|---|---|---|
| 0530779A3 | 2/1992 | European Pat. Off. . |
| 0530779A2 | 2/1992 | European Pat. Off. . |
| 0603143 | 8/1993 | European Pat. Off. . |

OTHER PUBLICATIONS

Metals Handbook Desk Edition, ASM, Ohio, 1985, pp. 28.23.

A Study of Effect of Carbon Content on the Structure and Properties of Sintered WC–Co Alloys–Joseph Gurland, Trans. AIME, Feb. 1954, pp. 285–290.

Thermodynamic Properties of the Co–W–C System–Armando Fernandez Guillermet, Met. Trans. A, vol. 20A, 1989, pp. 935–956.

The Microstructural Features and Cutting Performance of the High Edge Strength Kennametal Grade KC850*–B. J. Nemeth, Proceedings of the 10th International Plansee Seminar, 1981, pp. 613–627.

*Primary Examiner*—Donald P. Walsh
*Assistant Examiner*—Scott T. Bluni
*Attorney, Agent, or Firm*—John W. Gregg

[57] ABSTRACT

Processes are disclosed in which cemented carbide parts, having a wide range of initial carbon levels, and a wide range of sizes, can be carburized to a critical carbon level, and then slow cooled at various rates, to yield stratified enriched zones in the near-surface region of said parts. The enriched zones are characterized by the cobalt content decreasing, and the microhardness increasing, continuously through the enriched zones, and approaching values characteristic of the interior. The combination of stratified enriched zones in the near surface region and the 6% binder interior provide the toughness and deformation resistance required for heavy roughing applications.

A wide variety of cemented carbides, having different compositions and WC grain sizes, can also be carburized and slow cooled using the same techniques to yield stratified binder enriched zones having the same hardness profiles and cobalt content profiles as described above.

34 Claims, 2 Drawing Sheets

STRATIFIED ENRICHED ZONES FORMED BY THE GAS PHASE CARBURIZATION AND THE SLOW COOLING OF CEMENTED CARBIDE SUBSTRATES, AND METHODS OF MANUFACTURE

BACKGROUND OF THE INVENTION

1. Field of the Invention

This invention relates to a WC-based cutting tool having a combination of toughness and deformation resistance which consists of a cemented carbide substrate with a stratified, cobalt-enriched surface zone and a double-layer coating of titanium carbide and titanium nitride. The term "stratified" refers to the layered appearance of the cobalt in the enriched zone. This substrate provides high thermal and mechanical shock resistance for maximum edge strength and increased insert toughness. By combining the enriched surface layer with the core substrate at 6% cobalt, the propagation of cracks from the coating is prevented and the cutting edge still maintains a minimum of deformation due to the heat and high forces generated at the cutting edge. The double layer of TiC and TiN, applied by chemical vapor deposition, enhances insert wear resistance and surface lubricity thereby enhancing tool life.

This cemented carbide cutting grade is ideal for heavy roughing applications (that is, high metal removal rates) on carbon and alloy steels, tool steels, stainless steels and cast iron. The inherent toughness of this grade, as a result of the cobalt distribution through the enriched zone, provides reliable performance in interrupted cuts and in heavy-scale or out-of-round conditions found in castings and forgings. The coating protects the substrate from abrasion and chemical attack from scale and by the steel being machined.

The present invention further relates to a process of making a cutting tool substrate, specifically to the achievement of a critical carbon level in the substrate, the slow cooling of the substrate to achieve a specific cobalt profile through the enriched zone, and maintaining high cobalt contents at the top of the enriched zones prior to coating, to make the tool suitable for heavy roughing applications.

The present invention also relates to the achievement of the critical carbon levels in a variety of cemented carbide compositions such that stratified enriched zones are formed during slow cooling, having the same cobalt profiles and hardness profiles as described above.

2. Description of Related Developments

Phase equilibria in the W—C—Co system have been reported by J. Gurland ["A Study of the Effect of Carbon Content on the Structure and Properties of Sintered WC—Co Alloys", Trans. AIME, 200, 285–290 (1954)] and by A. F. Guillermet ["Thermody namic Properties of the Co—W—C Sytem" Metall Trans A, 20A, 935–956 (1989)].

Lueth, U.S. Pat. No. 4,579,713 describes the adjustment of the carbon content of Co—WC compositions (straight grades only) using H2-CH4 gas mixtures in the temperature range 800° to 1100° C. It must be emphasized that these materials do not contain free carbon; that is, they are not in C-porosity. Also, the gas treatments are performed at well below sintering temperature while the parts are in their porous, un-sintered states.

In the technique disclosed by Lueth, CH4:H2 ratios are chosen so that the carbon activity is less than unity (easily calculated from the equilibrium reaction $CH4 \leftrightarrows C+2H2$) so as to prevent the parts from moving into the free carbon region. The carbon activity of the parts will be controlled by the carbon activity of the gas phase. In this manner, initially high carbon parts can be decarburized, while initially low carbon parts can be carburized, and all will arrive at the same carbon level, or magnetic saturation value, within the two-phase WC+Co region of the phase diagram.

We have found this technique to be unsatisfactory for adjusting the carbon content of parts to specific levels within the free carbon region. It was far too sensitive to the CH4:H2 ratio, the temperature, the gas flow rates, and the manner in which the gases were introduced and removed from the furnace.

It has been known for several years within the cemented carbide industry that stratified enriched zones (so called because of the presence of wavelets, or strata, of cobalt parallel to the surface) can be produced by cooling parts containing free carbon. B. J. Nemeth, A. T. Santhanan and G. P. Grab ["The Microstructural Features and Cutting Performance of the High Edge Strength Kennametal Grade KC850", Proceedings of the 10th International Plansee Seminar, pp. 613–627 (1981)] were the first to describe this microstructure in a substrate having a nominal composition 6%Co-6%TaC-2%TiC-balance W and C. An appropriate amount of carbon was added to the powder batch in order to achieve the required carbon level. Details of the sintering and cooling of the parts (temperatures, cooling rates, gases used—if any, etc.) were not reported. Hardness measurements showed that the hardness increased continuously through the enriched zone and leveled off at a value appropriate for the interior.

Nemeth, et al., U.S. Pat. No. 4,610,931 have commented on the difficulty of controlling the carbon level, and hence the stratified enriched zones, in C-porosity substrates. In this patent, they described how a different type of cobalt enrichment, namely beta-free as opposed to stratified, can be obtained by the addition of hydrides, nitrides or carbonitrides of Group VB or VB transition elements to the powder mix.

This type of enriched zone is generated during vacuum sintering (due to the escape of nitrogen from the near-surface region, in the case of TiN or TiCN additions). These enriched zones are entirely free of solid solution carbide [W, Ti, Ta(Nb)C] grains, and they do not contain wavelets of cobalt. This type of enrichment occurs in cemented carbides having carbon levels ranging from eta phase to C-porosity, provided they contain any of the above additions (and, of course, solid solution carbides).

Taniguchi et al, U.S. Pat. No. 4,830,930 disclose the treatment of carburized transverse rupture strength (TRS) bars (composition 86%WC-5%TiC-7% Co) in a decarburizing atmosphere consisting of 10 torr H2-10% C02 mixture for 2 minutes at 1310° C., followed by furnace cooling in a vacuum This resulted in a cobalt enriched surface layer in which the cobalt concentration actually went through a minimum before it approached the concentration of the bulk. There is no showing that the parts are in the C-porosity region.

Minoru et al, U.S. Pat. No. 4,911,989 disclose sintered and cooled parts pressed from powders containing excess carbon and titanium carbonitride powder, or treated parts containing excess carbon in nitrogen gas from 1000° C. to 1450° C. during the sintering cycle to achieve the same result. Such nitrogen-containing compositions gave rise to beta-free enriched zones, approximately 5 microns thick, which lie above the stratified enriched zones.

In one example, they have taken a composition not containing excess carbon or TiCN, sintered it at 1450° C. and then cooled the furnace at 2° C./minute down to 1310° C. in an atmosphere of CH4 and H2, and then cooled the furnace to 1200° C. at 0.5° C./minute in a vacuum ($10^{-5}$ torr) or in a C02 atmosphere. They claim the same hardness profile and the same 5 micron solid solution carbide-free layer at the surface.

Only one size of insert was studied (SNG 432, which is ½ inch square by 3/16 inch thick). The H2—CH4 gas composition and pressure are not reported, and the carbon level reached has not been reported. No showing is made as to the carburization of the parts.

We have not found it necessary to resort to such complicated cooling procedures in order to achieve hardness profiles in which the hardness increases continually through the enriched zone and levels off at the bulk value.

The as-sintered parts were then treated in acid to remove cobalt to depths of 2 to 5 microns below the top of the enriched zone. After coating the parts, the hardness at the original interface is greater than that of the bulk, and drops rapidly over this 2–5 micron region.

Okada et al, U.S. Pat. No. 5,106,674 have described the slow cooling in H2 and in CH4, over the temperature region 1380° to 1300° C. of compositions containing free carbon, to achieve a specific hardness profile through the enriched zones. The description is as follows: The hardness is essentially constant for a distance of approx. 10 microns from the surface of the part, and then increases to a value characteristic of the interior of the part. They state that these tools are suitable both for high speed cutting and for heavy duty cutting, as a consequence of the above-described cobalt distribution through the enriched zone.

Free carbon is present in the interior of their sintered parts, but they do not claim that a specific well-defined carbon level is required. The implication is that the carbon content of the part is not critical as long as it is somewhere in the C-porosity region prior to cooling, and that cooling the parts at rates of 0.2° C./minute to 2° C./minute in CH4 or H2 will result in the claimed cobalt distribution throughout the enriched zones.

No discussion is made as to the carburization of the parts. The emphasis in this patent is clearly on the cooling of the parts in CH4 or H2 in order to achieve a specific enriched zone description. Furthermore, during the cooling of the parts, if the CH4 or H2 pressure is outside of the limits 0.1 torr to 10 torr, or if the rate of cooling is outside the limits 0.2° C./minute to 2° C./minute, "it is impossible to obtain the aforementioned blade member according to the present invention".

Only one size of insert (style SNMG 120408, which is 12 mm square by 4 mm thick) is described in this patent.

SUMMARY OF THE INVENTION

The present invention is directed to the carburization at sintering temperature, using CH4 and H2-CH4 mixtures at subatmospheric pressures, of a commercial Co—WC—TaC—TiC substrate (nominal composition 6 wt % Co, 6 wt % TaC, 2.5 wt % TiC, balance W and C) such that parts pressed in a wide range of thicknesses (⅛ inch thru ½ inch) and having a wide range of initial carbon porosities (C02 thru C08) can be carburized to the critical C08 carbon porosity, and on slow cooling in low pressure argon, will exhibit stratified zones characterized by specific hardness profiles and cobalt profiles. The hardness increases continuously through the entire enriched zone—even through the first 10 microns from the surface—and slowly approaches a value characteristic of the interior of the part. And, consistent with these results, the cobalt content decreases continuously through the enriched zone and levels off at a value characteristic of the interior. The coated tools are specifically designed for heavy duty cutting; a high concentration of cobalt at the substrate/coating interface provides the necessary toughness for this type of application.

The carburization treatment of the present invention will not cause initially carbon-correct parts to become over-carburized, even for extremely small parts, if sufficient care is taken in the selection of the methane content of the gas mixture, the flow rates, the pressure, the temperature, and the manner in which the gases are introduced and removed from the work box.

DETAILED DESCRIPTION OF THE PREFERRED EMBODIMENT

Figure 1:
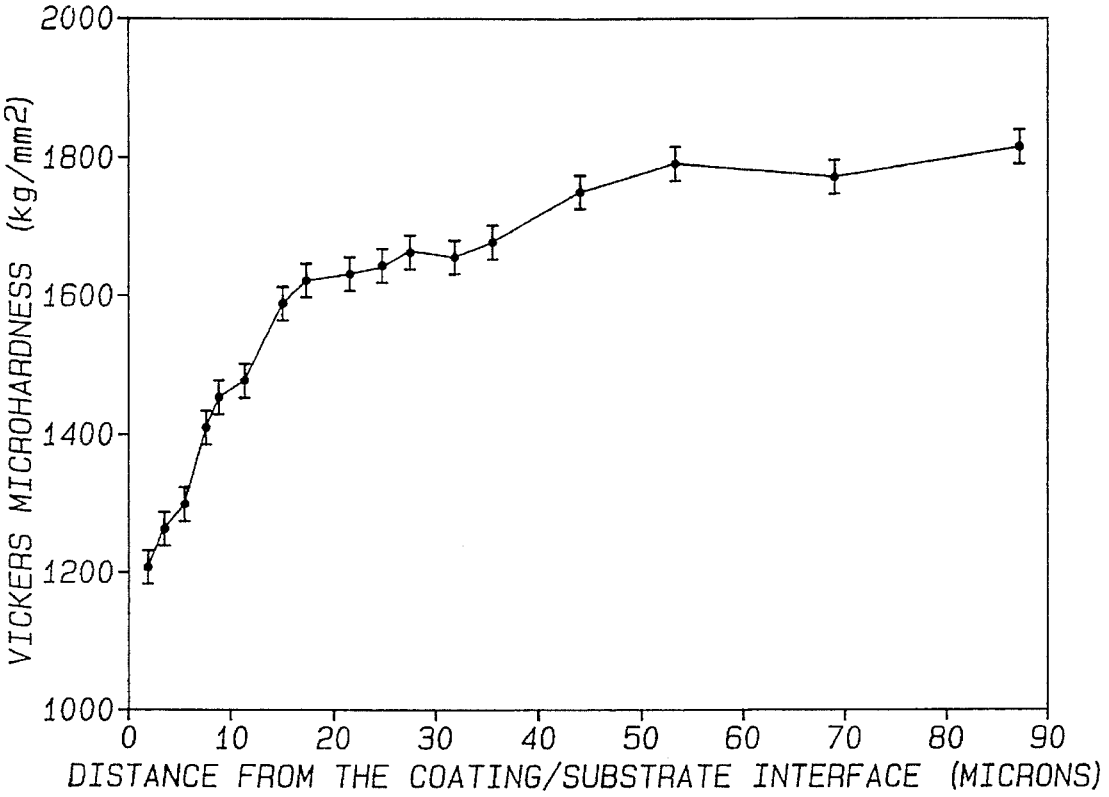
FIG. 1 is the Vickers microhardness of a treated substrate as a function of the distance from the coating/substrate interface.

A stratified substrate is extremely difficult to manufacture. The stratification develops when the part, having a critical carbon content, is cooled slowly through the three phase WC-liquid binder-solid binder region of the phase diagram. This critical carbon content is a very narrow range in the free carbon region centered around the C08 porosity rating [The rating of porosities is in accordance with ASTM B276 ("Standard Test Method for Apparent Porosity in Cemented Carbides", B276, Annual Book of ASTM Standards, American Society for Testing and Materials, 1916 Race Street, Philadelphia Pa. 191030.] Our experiences have shown that for a given cooling rate—typically 1.5° C./minute—acceptable enriched zones for optimum metal cutting performance are obtained with a carbon window of only ±0.007 weight percent carbon. This is less than the precision of carbon determinations by chemical analyses (±0.02 weight percent) and considerably less than the carbon control required on conventional grades (±0.05 weight percent). Such a fine control of the carbon level is extremely difficult to achieve.

It is difficult to formulate weighed amounts of the constituent powders (WC, WTiC, TaC, cobalt and carbon), execute the many production steps (milling in an organic solvent, screening, addition of the fugitive binder and spray drying) and generate an alloy powder that will sinter to the precise requisite carbon level. Even if one is fortunate enough to achieve this in the freshly prepared powder, there is an aging phenomenon which lowers the sintered carbon level. Air and moisture slowly oxidize the finely divided cobalt. Then, during subsequent sintering of the pressed parts, carbon will be lost (as carbon monoxide) as these oxides react with the tungsten carbide and excess carbon in the part. Also, the pressed parts will slowly age while they are waiting for sintering.

There is also a size effect; that is, larger size parts pressed from the same powder and sintered in the conventional manner in the same heat, will end up with slightly higher carbon contents. This size effect is noticeable even with the freshly prepared powders and is due, we believe, to the progressive difficulty of the paraffin wax to escape from the larger parts during the dewax portion of the cycle. This results in the cracking of the wax and the deposition of carbon in the interior of the parts. As the pressed parts age, the size effect becomes even more noticeable because the smaller parts will be influenced by air and moisture to a greater extent than the larger parts.

The related approach, the one discussed here, is to achieve a specific carbon level in the parts through gas phase carburization, regardless of size or initial carbon level, and then to control the nature of the enriched zone by cooling at the appropriate rate in 1 torr argon.

In the as-sintered state, the stratified substrate has a thin graphite layer and a thin cobalt layer (each approx. 2 microns thick) above the stratified enriched zone. The periphery of the as-sintered part is free of carbon precipitates, to depths of 100–150 microns, while the interior has an approx. C08 carbon porosity rating. The distribution of the solid solution carbide grains through the enriched zone is noteworthy. The concentration of these grains is quite small at the top of the zone, and they increase continuously through the enriched zone to approach the bulk concentration.

The present invention is directed to a process for carbon adjustment of cemented carbide substrates via furnace atmosphere control during the sintering process, to bring all parts to a critical carbon level, followed by cooling in low pressure argon at specific rates to achieve specified stratified enriched zones on the near-surface region of the parts. The process involves placing green cemented carbide substrates into a vacuum furnace on graphite trays coated with a carbon slurry. The parts are dewaxed in a vacuum or in a sweep of low pressure argon. The temperature is slowly increased, at a rate of 5° to 10° C. per minute, until the sintering temperature of approx. 1370° C. is achieved. At this point, methane or a mixture of hydrogen and methane is introduced into the furnace vessel or directly into the work box. The flow of gas may be continuous or pulsed, and is at a pressure of from about 1 torr up to about 90 torr, but preferably 1 torr to 30 torr. The gases are pumped out through the main roughing line or through the delube tube that is directly connected to the work box. The gas flow is continued for a time sufficient to bring large initially carbon-deficient parts up to the required C08 porosity level. The carburizing gas mixture is then pumped out of the furnace, and argon is introduced at a relatively low flow and maintained at a pressure of 0.5 to 2 torr to prevent the loss of cobalt from the substrate.

The furnace is then cooled slowly, at rates of about 0.5 to 9 degrees Celsius per minute to temperatures below the solidus temperature of approx. 1280 degrees to give enriched zones characterized by continuous increases in the microhardness and by continuous decreases in the cobalt content throughout the enriched zone as one moves away from the surface toward the interior of the parts.

The rate of cooling determines the amount of cobalt in the enriched zone and the depth of the enriched zone. The metal cutting performance of the finished coated tool will depend upon the stratified enriched zone, and thus the rate of cooling of the substrate must be appropriate for the intended metal cutting conditions, i.e., speed, feed, depth of cut, workpiece material, and type of machining operation.

Prior to coating, the thin cobalt layers that form above the enriched zones on the as-sintered parts are removed down to the WC grains at the top of the zone, but the cobalt between these grains is not removed. The high cobalt content at the top of the zone is thus preserved, making the subsequently coated tools suitable for heavy roughing applications. The hard coatings are deposited on the surfaces of the binder enriched substrate by chemical vapor deposition or by physical vapor deposition from a list consisting of TiC, TiCN, TiN and $Al_2O_3$. In this particular application the coatings were CVD coatings of TiC and TiN, each approx. 6 microns in thickness.

The following examples are given to illustrate various aspects of the invention. Those skilled in the art will recognize that these examples are not limiting in any way to the scope and spirit of the invention.

EXAMPLES

All sintering runs were performed in a Vacuum Industries Sintervac Model-40 furnace in the following manner. The parts were dewaxed in differential pressure argon (approx. 5 torr) while the furnace was ramped at 5° C. per minute to 420° C. with a 90 minute hold at 420° C. Under vacuum, the temperature was then increased at 6° C. per minute to 1,200° C. with a 42 minute hold at this temperature. The temperature was then increased at 5° C. per minute toward the sintering temperature. At approximately 1,300° C. argon was introduced into the furnace at approx. one liter per minute and the pressure was maintained at approx. 1 torr in order to minimize the evaporation of cobalt. At sintering temperature of approx 1370° C. the reactive gas mixture was introduced into the furnace in order to adjust the carbon content of the load. The hold time was standardized at 200 minutes after several preliminary experiments. At the end of the 200-minute hold the reactive gases were pumped from the furnace, the pressure was then maintained at approx. 1 torr with flowing argon at about one liter per minute, and the parts cooled at 1.5° C. per minute to a temperature below the solidus (approx. 1280° C.). To ensure that all regions of the work box were well below this critical temperature, the cooling was continued until the temperature was approx. 1260° C. or lower.

At least four inserts were included in all heats to represent the four extreme conditions—namely, a 3/16 inch thick insert that normally sintered in 1 torr argon to C02 porosity, a 3/16 inch thick insert that normally sintered to C08 porosity, and ½ inch thick inserts that normally sintered to C02 and C08 porosities. Later in the studies, the lower size limit was extended to include ⅛ inch thick inserts which normally sintered to the two extreme carbon levels. All parts measured ½ inch by ½ inch in the other two dimensions.

A cooling rate of 1.5° C. per minute was arbitrarily chosen initially for the development and evaluation of this carburization technique. As discussed above, cooling rates were later determined which gave the desired metal cutting performance of the finished tools.

One criterion for success was that the initially carbon-deficient parts, after carburization and slow cooling, exhibited C08 porosity in the interior of the part, and enriched zones described as M-H/55–60.

The other criterion for success was that the initially carbon-correct parts did not become over-carburized. Over-carburization is manifested by the cloudy or dull appearance of the part, and, on cross-sectioning and polishing, on the observation of rough carbon layers and the absence of cobalt layers above the enriched zones.

A rating scheme was developed to assess the cobalt enriched zones based on optical examination of polished and etched cross-sections at 1000X. This was necessary because carbon analyses are not sufficiently accurate, and the metallographic rating of excess carbon is too subjective. Magnetic saturation (Ms) measurements are no help since the Ms is the same regardless of the amount of excess carbon. The physical appearance of the sintered part is of no help either—the part will have a black shiny luster at any excess carbon level. However, the parts will take on a cloudy or dull appearance if they enter the nodular carbon region; that is, if they become over-carburized.

The optical microscope rating scheme that was developed was based on the amount of cobalt in the enriched zone (slight [S], moderate [M], heavy [H], and on the depth of the enriched zone (in microns). Ten categories were defined: Negligible, S/20, S-M/25, S-M/30, S-M/35, M/40, M-H/45–50, M-H/55–60, M-H/65, and H/70–75.

Initial studies were performed with positive pressure (approx. 830 torr) H2-CH4 mixtures in the temperature region 800° to 1100° C., while the parts were in the porous, pre-sintered state. But we found that the results were very sensitive to the methane content, the temperature, the flow rates, and the manner in which the gases were introduced and removed from the furnace.

We abandoned this approach to examine gas treatments at sintering temperatures; this is, gas treatments after pore closure had occurred and liquid cobalt was present. Several experiments were performed with positive pressure hydrogen at 1370° C. (the usual sintering temperature for this C-porosity substrate). Hydrogen under these conditions of temperature and pressure were found to react with the insulation and the graphite furniture in the furnace to form a H2-CH4 mixture, which in turn carburized the parts. But the carburization was found to be too aggressive in the small parts tended to become overcarburized. Furthermore, we were not in control of the process.

There are other reasons for not pursuing this approach. The power requirements for operating a furnace in positive pressure hydrogen at sintering temperatures is quite high, approximately twice that which is required for 1 torr argon at the same temperature. Also, backfilling the furnace with argon prior to the reactive gas treatment, and flushing the hydrogen and methane from the furnace with argon at the end of the gas treatment (for safety reasons), is time consuming.

We then pursued carburization at sintering temperatures using CH4 and H2-CH4 mixtures at sub-atmosphere pressures. We have used H2-CH4 mixtures that are rich in methane, or we have used pure methane. Indeed the CH4:H2 ratios were well above that required to achieve a carbon activity of unity at 1370° C. (CH4:H2=0.0013). Thus the reaction CH4=C+2H2 is driven to the right, and carbon is deposited throughout the furnace, and onto the cemented carbide parts. This carbon then slowly diffuses through the liquid cobalt into the interior of the parts. We believe that carbon is taken up until the solubility limit of carbon in cobalt is reached. This then is the "endpoint" of gas phase carburizations performed at sintering temperatures. It should be emphasized that this is strictly a carburization process; we are not attempting to decarburize parts that are initially beyond the C08 carbon level. Thus, the principals involved are quite unlike those of the Lueth process.

Examples 1 through 20 are concerned with the development and assessment of low pressure/high temperature gas phase carburization and slow cooling procedures for one particular nominal composition (WC-6.0 wt % Co-2.5 wt % TIC-6.0 wt % TaC). Example 21 shows Vickers microhardness and cobalt content through the stratified enriched zones. In Example 22, metalcutting results are reported. Example 23 deals with the low pressure/high temperature carburization and slow cooling of a wide variety of cemented carbide compositions, to yield binder stratified enriched zones in which the microhardness and binder profiles are similar to those shown in FIGS. 1 and 2.

Example 1

Run 1

In the early experiments, the work box was configured so that there were well-directed flows of gases across the trays. The gases entered the work box, travelled sequentially across two trays, entered a plenum region at the back of the work box, and then travelled across four trays and exited through holes in the front panel. The gases were pumped from the furnace through the main roughing line.

The gas treatment consisted of H2-3% CH4 (5 liters/minute H2, 150 cc/minute CH4) at 90 torr pressure, for 200 minutes at 1370° C. Cooling was at 1.5° C./minute in 1 torr argon down to 1260° C. Examination of the four test inserts revealed that they were at the desired C08 porosity level, with enriched zones described as M-H/55–60. The parts that were initially at the C08 porosity level showed no evidence of over-carburization. No trends were observed across the graphite tray.

The experiment was repeated at 50 torr pressure and at 30 torr pressure with the same result.

Run 2

An experiment was performed using pure hydrogen (5 liters/minute flow rate) at 90 torr pressure for 200 minutes at 1370° C. The initially carbon-deficient 3/16 inch thick part had been carburized from the CO2 to the CO6 carbon porosity level, and the initially carbon-deficient ½ inch thick part had been carburized from the CO2 to the CO2/CO4 porosity level. Thus, even at 90 torr pressure the hydrogen is reacting with the graphite furniture or the carbon insulation to produce a slightly carburizing gas mixture.

Run 3

The experiment was repeated using pure hydrogen at 30 torr pressure (5 liters per minute flow rate) for the usual 200 minutes at 1,370° C. Examination of the test inserts showed that the carbon levels were completely unchanged. This means that hydrogen at 30 torr pressure and below, at 1,370° C., was not reacting with the carbon insulation or the graphite furniture in the furnace to form a H2-CH4 mixture that can carburize the parts. Thus, the methane that was mixed with the hydrogen and introduced into the furnace was responsible for the carburization of the parts. Thus, by controlling the methane-to-hydrogen ratio we can control the carburization process. This was to be contrasted with the use of higher pressures of hydrogen at 1370° C.

Run 4

The experiment was repeated at 15 torr, 5 torr and 1 torr using H2-3% CH4 gas mixtures (5 liters/minute H2, 150 cc/minute CH4) and, as above, directing the gas flow directly into the work box in the furnace. In every instance, the usual four test inserts were at the desired C08 porosity level, and exhibited enriched zones described as M-H/55–60.

Run 5

Next, the flow rate of the hydrogen was reduced to 2 liters per minute and the gas mixture was altered to a H2-20%

$CH_4$ gas mixture. The results were the same as those obtained above.

Run 6

In another run, the parts were subjected to a $H_2$-3% $CH_4$ gas mixture at 5 torr but at reduced gas flow rates (1 liter/minute $H_2$, 30 cc/minute $CH_4$). The large, initially carbon-deficient part did not quite reach the desired carbon porosity level. Thus, a minimum gas flow rate is required.

Example 2

An experiment was performed in which the flow of gases was different from the previous cases. It was of interest to perform the reactive gas treatments in the same manner as the dewaxing treatment. That is, during differential pressure dewaxing the argon was passed into the furnace chamber, through the holes at the front of the work box, over the parts on the four trays, into the plenum region and then out through the delube tube (which allows for direct pumping on the work box). To accomplish this the $H_2$-$CH_4$ gas line was disconnected just beyond the insulation package, and the hole in the top of the graphite work box was plugged.

The experiment was performed at 25 torr pressure with a $H_2$-3% $CH_4$ gas mixture (5 liters/minute $H_2$, 150 cc/minute $CH_4$) for 200 minutes at 1370° C. Cooling was at 1.5° C./minute in 1 torr argon down to 1260° C. The experiment results were that all test pieces were at the desired C08 carbon level and exhibited M-H/55–60 enriched zones.

Example 3

Run 1

In order to scale-up to production, lower flow rates were tested to determine the effectiveness of producing fully carburized inserts. Pure methane gas was used at 5 torr pressure and at flow rate of 5 liters per minute. Once again, the inserts exhibited the desired C08 porosity and had the desired enriched zones.

Run 2

In another run, pure methane at 10 torr pressure was used at a flow rate of 1 liter per minute. The gas flow was directed inside the insulation package, but not intentionally directed into the graphite work box. Access of the gas into the work box was provided by drilling a 6-by-5 array of ⅛ inch diameter holes into both of the end plates of a different graphite box. In addition, the trays were shorter than the inside length of the box such that there were ½ inch gaps between the ends of the trays and the ends of the box. Three groups of the usual four test inserts were placed at the front, middle and back of Tray 2. The gas treatment lasted the usual 200 minutes at 1,370° C.

Examination of the polished cross sections revealed that all of the inserts showed the desired enriched zones.

Example 4

Pulsing the gas mixture over the inserts is a way to avoid having to arrange well directed flows of gases across many trays, and to guarantee frequent exchange of gases through the work box. We tried pulsing sub-atmospheric gases over the inserts to determine whether the desired carburization would occur.

We used the same graphite box as in the previous example, i.e., having holes drilled into the ends of the box, with ½ inch gaps between the trays and the ends of the box. Also, as in the previous example, the gas was not directed into the box, but rather into the volume inside the graphite insulation package. Pure methane gas was admitted into the furnace at 1 liter per minute flow rate to a pressure of about 10 torr (with the roughing valve closed), there was a 1 minute hold, and then the gases ($H_2$ and $CH_4$) were pumped out to a pressure of about 1 torr, then the furnace was immediately backfilled to 10 torr, etc. During the hold at 10 torr, (and during the backfill itself) the pressure rose due to heating of the gases, and to the fact that two volumes of hydrogen are produced from each volume of methane, according to the reaction $CH_4 = 2H_2 + C$. The pressure typically rose from 10 torr to approximately 13 torr.

Pumping of the gases out of the furnace took about 7 seconds, and backfilling took about 25 seconds. Therefore, one cycle took approximately 1.5 minutes. During the 200 minutes of gas treatment, there were approx.130 changes of gas.

As above, three groups of the usual test inserts were placed at the front, middle and the back of Tray 2.

The polished cross sections at the end of the experiment showed all parts had the same C08 porosity rating and the desired enriched zones.

Example 5

A series of three experiments were performed in which the gas treatment temperature was held at 1345°, 1370°, and 1395° C.

At this point in time the work box was configured so as to give well directed flows of gases across the four trays; however, how the gases entered and exited the box is not an issue in this particular study. All three experiments were performed using the same $CH_4$ content (3%), the same pressure (30 torr), the same flow rates (10 liters/minute $H_2$, 300 cc/minute $CH_4$), and the same time (200 minutes). In all cases the parts were cooled in 1 torr argon at 1.5° C./minute down to below 1260° C.

In all cases, all of the test inserts exhibited M-H/55–60 enriched zones. Thus, the results are quite insensitive to the temperature of the gas treatment. This is a very important consideration for a process that will be used in a production environment using large vacuum sintering furnaces. Temperature gradients of ±25° C. throughout the hot zone of large production furnaces are not unusual.

There were even no detectable changes in the coercive force (Hc) of the parts treated in the three experiments, provided, of course, that similar parts are compared since four different powder batches were used.

The only differences that could be detected were the sizes of the carbon dendrites, or clusters (examined at 100X on the unetched cross-sectioned parts), in the interior of the parts. There was a subtle increase in the size of the clusters as one went to increasing temperatures.

Example 6

In the Vacuum Industries Sintervac-40 furnace the trays were situated one above the other with ½ inch gaps between the ends of the trays and the front and back plates of the work box.

For this experiment, a 6-by-5 array of ⅛-inch diameter holes, separated by one-inch, was drilled into each of the two end plates of the work box. This was to allow ready access of the reactive gases to the parts. Pure methane was introduced into the furnace inside the insulation package (but not introduced directly into the work box) at 1 liter/minute, and the pressure was maintained at 10 torr for the usual 200 minutes at 1370° C. The gases were pumped out through the roughing port situated in the bottom rear of the furnace chamber.

The usual sets of test inserts (3/16 inch and ½ inch in thickness, and C02 and C08 in carbon porosity level) were placed at the front, the middle and the back of Tray 2. The furnace was cooled in 1 torr argon at 2.0° C./minute rather than 1.5° C./minute.

All the test inserts were at the C08 porosity level and exhibited enriched zones rated as M-H/50; none were over-carburized.

Example 7

A 50–50 mixture of H2-CH4 was pulsed from 1 torr to 10 torr for the usual 200 minutes at 1370° C. The gases were directed into the work box, and the end plates were solid.

The gases were introduced directly into the work box by connecting the inlet tube to the top center of the box. The gases entered the box, impinged on the top tray, and then travelled at least half the distance of the length of the trays (½ of 17 inches) before they encountered any inserts. Thus, there was a reasonable probability that the gases would be in thermal equilibrium before they encountered any inserts. Also, graphite blocks were added to the top tray in order to force the gases to have many collisions as the mixture travelled across this tray. The gases were pumped from the furnace through the roughing line situated at the bottom rear of the chamber.

We did not want the gases to be rushing into the box of a high velocity since this would defeat the desire to have the gases at thermal and thermodynamic equilibrium when they encounter the inserts. Thus, we arranged the flow rates (300 cc/minute each) such that it took approx. 60 seconds to backfill the furnace to 10 torr. Also, we did not want the gases to be pulled from the work box at a high flow rate; we throttled the pump so that it took approx. 30 seconds to reduce the pressure down to 1 torr. Cooling was at 1.5° C./minute in 1 torr argon down to at least 1260° C. All the test inserts showed the expected M-H/55–60 enriched zones.

Example 8

The trays were stacked one above the other with approx. ½ inch gaps between the ends of the trays and the end plates, and the end plates were solid.

The gases were introduced directly into the work box as described in Example 7. Three experiments were performed at 20 torr pressure, for 200 minutes at 1370° C. using 5000 cc/minute of hydrogen containing 2, 3 and 7 percent methane. Cooling was at 1.5° C./minute in 1 torr argon down to 1260° C. Three sets of four test inserts (3/16 inch and ½ inch in thickness, and C02 and C08 in carbon porosity level) were placed at the ends and the middle of Tray 2.

In all cases the test inserts sintered to the C08 carbon level and exhibited the expected M-H/55–60 enriched zones. In the H2-7% CH4 experiment, there was no evidence of rough carbon layers on any of the inserts.

Thus, the allowable range of methane contents is rather wide—at least 2 to 7 percent for the given flow rate (5 liters/minute H2) and the given pressure (20 torr). This makes it an attractive technique in a production environment.

Example 9

Two additional pulsing experiments were performed with the above work box configuration.

The object, of course, was to guarantee the exchange of gases in the work box. The electrical circuitry was such that the pulsing was completely automatic. The gas flows into the workbox/furnace chamber until the pressure rises to the upper pressure limit, then the roughing valve opens. The throttle valve just in front of the blower/mechanical pump was set so that we could pump down to a lower pressure limit in a length of time that could be controlled. Then the roughing valve closed and the furnace was backfilled again. The gas flow was not interrupted when the pressure reached the upper limit.

In both experiments, a 50–50 H2-CH4 mixture (700 cc/minute flow rate of H2 and CH4) was pulsed from 1.5 to 20 torr for the usual 200 minutes at 1370° C. Backfilling took 60 seconds and pumpdown took 45 seconds, to give approximately 115 cycles during the 200-minute hold. Test inserts were placed at the front, the middle, and the back of all four trays.

In one heat, the H2-CH4 gas flow was divided between the work box and the furnace chamber in the ratio 1:10 (the ratio of the respective volumes). In the other heat, all the gas entered the workbox.

In both cases, all the parts were at the desired enrichment level. There were no trends across a given tray, and there were no trends from tray to tray.

Example 10

As in the previous examples, the trays were stacked one above the other with approx. ½ inch gaps between the ends of the trays and the end plates, and the end plates were solid. The gases were introduced directly into the top center of the work box. The gases were pumped out of the furnace through the roughing line.

Several pulsing experiments were performed from approx. 1 to 20 torr; the CH4 content was varied, the flow rates of the gases (and hence the backfill times) were varied and the pumpdown times were varied. The gas treatment was for the usual 1370° C. for 200 minutes, and cooling was at 1.5° C./minute in 1 torr argon. The information is summarized in Table I.

TABLE I

CARBURIZATION OF TEST INSERTS BY PULSING WITH H2—CH4 MIXTURES FROM APPROX. 1 TO 20 TORR FOR 200 MINUTES AT 1370° C.; GASES DIRECTED INTO WORK BOX; COOLING AT 1.5° C./MINUTE IN 1 TORR ARGON

| FLOW RATES CC/MIN | BACKFILL TIME | PUMPDOWN TIME | NO. OF | M-H/55–60 ENRICHED ZONES ACHIEVED IN THICKNESS OF | | |
|---|---|---|---|---|---|---|
| H2/CH4 | (SEC) | (SEC) | CYCLES | 3/16" | ¼" | ½" |
| 5000/150 (3%) | 25 | 45 | 103 | YES | YES | NO |
| 3000/150 (5%) | 41 | 27 | 176 | YES | YES | NO |
| 10000/300 (3%) | 13 | 27 | 300 | YES | YES | NO |
| 3000/300 (10%) | 37 | 27 | 200 | YES | YES | YES |
| 4000/280 (7%) | 30 | 27 | 210 | YES | YES | YES |

All the parts came up to the expected M-H/55–60 enrichment level, except for the large ½-inch thick initially carbon-deficient inserts in the earlier experiments. These parts exhibited enriched zones of S-M/35–40, M/40–45, and M-H/50–55, respectively. We estimate that the range of conditions that give the desired results for all sizes (⅛ thru ½ inch thickness) and all initial carbon porosity levels (C02 thru C08) is 4 to 7% methane for hydrogen flow rates 5000 cc/minute (which gives a backfill time of 25 secs) and a pumpdown time of 27 secs. Thus, there is plenty of latitude in the methane content to make this a viable technique in a production environment.

Example 11

We began to include ⅛-inch thick inserts in the experiments as soon as the decision was made to offer insert styles in this thickness. Our studies up to this point, using 3/16-inch thick inserts as the smallest inserts showed that they seem to be susceptible to becoming slightly over-carburized particularly if they were situated at the extreme ends of the sintering trays. Test inserts (⅛, 3/16 and ½ inch in thickness, normally sintering to the C02 and the C08 carbon porosity levels) were placed at the extreme front, the extreme back, and the middle of Tray #2. A H2-6% CH4 mixture (6 liters/minute H2, 360 cc/minute CH4) was pulsed from 1.5 to 20 torr for 200 minutes at 1370° C. The parts were then cooled in 1 torr argon at 2.7° C./minute to give enriched zones more suitable for metal cutting.

None of the parts were over-carburized. Cross-sectioning, mounting and polishing of the parts revealed enriched zones compatible with the faster cooling rate.

Example 12

A carburization experiment was performed in which the gas treatment was for 400 minutes at 1370° C. rather than the usual 200 minutes. The usual assortment of test inserts (⅛ inch thru ½ inch in thickness, C02 thru C08 in carbon porosity level) were placed in the work box. A H2-6% CH4 mixture (6 liters/minute H2, 360 cc/minute CH4) was pulsed from 1.5 to 20 torr (backfill time 21 seconds, pumpdown time 27 seconds); the furnace was then cooled in 1 torr argon at 2.6° C./minute down to 1260° C.

None of the parts were over-carburized. Cross-sectioning revealed enriched zones exactly the same as we have seen after 200 minutes of gas treatment and cooling at the same rate. This was consistent with our beliefs; we maintain that carbon is being picked up until the solubility limit of carbon in cobalt is reached. If the parts reach this limit after 200 minutes of carburization, they should not go beyond it even after 400 minutes.

Example 13

We turned our attention to reheats. We were interested in weight losses, changes in Hc, and changes in the enriched zones. A large number of inserts, including style TNMA 444 (triangular ½ inch IC, ¼ inch thick) and style LNU 6688 (rectangular, 1½ inch long, ¾ inch wide, ½ inch thick) were included in a carburization heat [H2-6% CH4 mixture, 6 liters/minute H2, 360 cc/minute CH4, pulsed from 1.5 to 20 torr, backfill time 21 seconds, pumpdown time 27 seconds, 200 minutes, 1370° C.] and cooled at 2.7° C./minute in 1 torr argon. The TNMA444 inserts were then ground on all faces, and the LNU 6688 inserts were ground on top and bottom faces only. The parts were carefully weighed, and Hc measurements were obtained.

The parts were then subjected to a reheat which consisted of heating the parts in approx. 1 torr argon up to 1370° C. and holding for 100 minutes, and then cooling at 2.7° C./minute also in 1 torr argon. This regenerated the stratified enriched zone on all surfaces, not just on the ground surfaces. The parts were again weighed, and Hc measured again.

The weight losses depended on the size of the parts, but were quite small.

Reheating caused Hc to decrease approx. 8 oersteds, which was an average for a large variety of parts. This corresponded to a decrease in hardness (Ra) of no more than 0.1 units, which was less than the uncertainty in the measurements.

As for the enriched zones we observed a reduction corresponding to approx. one increment in our rating scheme. This is consistent with the fact that carbon layers have been removed by grinding, and thus the carbon content of the parts at sintering temperature (when the carbon has re-dissolved) has been slightly reduced. One can compensate for this by cooling the parts as a slightly lower rate than that employed during the original cool.

Example 14

A number of experiments were performed in which a variety of inserts were carburized [H2-6% CH4 mixture, 1.5 liters/minute H2, 90 cc/minute CH4, pulsed from 1.5 to 5 torr, backfill time 20 seonds, pumpdown time 20 seconds, 200 minutes, 1370° C.] and then cooled at various rates (0.5° to 8.0° C./minute) in 1 torr argon, in order to establish the cooling rates required to give enriched zones suitable for metalcutting.

In all of these studies it was found that the enriched zones exhibited by the tiny (2 gram) TNMG 222 inserts (triangular, ⅛ inch IC, ⅛ inch thick) were identical to those exhibited by the huge (132 gram) LNU6688 insets, for the same cooling rate, of course.

In several of these experiments, 2 gram inserts were situated in the extreme front and back of Tray 2 to see if there were any tendencies for these small parts to become over-carburized. No tendencies were found.

Example 15

This was a variation in the manner in which the gases were introduced into the work box and pumped from the work box. The gases were introduced into the furnace chamber outside the insulation package, rather than being directed into the work box. After entering a ⅝-inch diameter hole in the top center of the work box (which had solid end plates), the gases impinged on a graphite tray before encountering the test inserts placed on lower trays. The gases were pumped from the furnace through the dewax line which is connected to the bottom of the work box.

A series of experiments were performed in which the CH4:H2 ratios were varied, but using the same H2 flow rate (1.5 liters/minute), and pulsing the gases from 1.5 to 5 torr (backfill time 10 seconds, pumpdown time 10 seconds) for 200 minutes at 1370° C. In all cases the furnace was cooled at 3.5° C./minute in 1 torr argon to below 1260° C. The results are summarized in Table II.

TABLE II

CARBURIZATION OF TEST INSERTS BY PULSING WITH H2—CH4 MIXTURES FROM 1.5 TO 5.0 TORR FOR 200 MINUTES AT 1370° C.; GASES DIRECTED INTO THE FURNACE CHAMBER AND PUMPED OUT THROUGH THE DEWAX LINE; COOLING AT 3.5° C./MINUTE IN 1 TORR ARGON

| CH4:H2 | S-M/40 ENRICHED ZONES ACHIEVED IN THICKNESS OF | | |
|---|---|---|---|
| RATIO | ⅛" | 1/16" | ½" |
| 0.06 | YES | NO | NO |
| 0.10 | YES | YES | NO |
| 0.15 | YES | YES | YES |
| 0.225 | YES | YES | YES |
| 0.35 | YES | YES | YES |
| 0.50 | YES | YES | YES |
| 1.00 | YES | YES | YES |

With a CH4:H2 ratio of 0.06, only the ⅛ inch inserts could be brought to the desired enrichment level.

With a CH4:H2 ratio of 0.10, the ⅛ inch and the 3/16 inch inserts were successfully carburized.

With CH4:H2 ratios of 0.15 up to 1.00, inserts of all thicknesses could be brought to the desired carbon porosity level.

With CH4:H2 ratios of 0.35 and above, there was a progressive roughening of the flank faces of the tiny 2 gram inserts positioned at the extreme ends of the trays.

Thus, using CH4:H2 ratios ranging from 0.15 up to approx. 0.30 would allow inserts of all thicknesses to be brought up to the desired enrichment level, without causing the tiny 2 gram inserts to develop rough carbon layers.

Example 16

Another approach to the carburization of these cemented carbide materials involved the use of relatively low flow rates of relatively methane-rich mixtures, and maintaining the pressure at some convenient and safe level.

A series of experiments were performed in which the H2 and CH4 flow rates, and their ratios, were varied, but the pressure was arbitrarily maintained at 3 torr. The gases were introduced into the furnace chamber outside the insulation package. The gases entered the workbox through a ⅝-inch diameter hole in the top center of the workbox, and impinged on a graphite tray (containing graphite blocks and scrap inserts) before encountering the test inserts placed on lower trays. The gases were pumped from the furnace through the dewax tube connected to the bottom of the workbox. The carburizing gas treatments were for 200 minutes at 1370° C.; cooling was at 3.5° C./minute in 1 torr argon down to 1260° C. The results are summarized in Table III.

TABLE III

CARBURIZATION OF TEST INSERTS USING FLOWING H2—CH4 MIXTURES AT 3 TORR PRESSURE FOR 200 MINUTES AT 1370° C.; COOLING AT 3.5° C./MINUTE IN 1 TORR ARGON

| FLOW RATES CC/MIN | CH4:H2 | S-M/35-40 ENRICHED ZONES ACHIEVED IN THICKNESS OF | | |
|---|---|---|---|---|
| H2/CH4 | RATIO | ⅛" | 3/16" | ½" |
| 1000/200 | 0.20 | YES | NO | NO |
| 1500/300 | 0.20 | YES | YES | YES |
| 2800/560 | 0.20 | YES | YES | YES |
| 6500/1300 | 0.20 | YES | YES | YES |
| 800/400 | 0.50 | YES | YES | YES |
| 2100/1050 | 0.50 | YES | YES | YES |
| 4500/2250 | 0.50 | YES | YES | YES |

In the first experiment, only the small ⅛-inch thick initially carbon-deficient inserts came to the desired carbon level. But this is a perfectly reasonable result considering the low methane flow rate.

There was no evidence, in any of their experiments, of any over-carburization of the tiny 2 gram inserts situated at the extreme ends of the graphite trays.

Example 17

Two experiments were performed in which each end plate of the work box had a 6-by-5 array of ⅛-inch diameter holes separated by a distance of approximately one inch. This was done in order to improve the migration of the gases in and out of the work box. The gases were introduced into the furnace chamber above and outside of the insulation package. The gases were pumped out of the furnace through the roughing line situated at the bottom rear of the furnace chamber.

Two experiments were performed at 3 torr pressure. In one, the flow rates were 2.5 liters/minute H2 and 0.5 liters/minute CH4 (CH4/H2=0.20). In the other, the flow rates were 15 liters/minute H2 and 3 liters/minute CH4 (CH4/H2=0.20); this total flow rate was the highest possible which allowed 3 torr pressure to be maintained (pumping through the roughing line). Cooling was at 4.0° C./minute in 1 torr argon in both cases.

All the parts exhibited the desired S-M/35–40 enriched zones. None of the 2 gram inserts showed any evidence of over-carburization.

Example 18

Three experiments were performed with flowing H2-CH4 mixtures. The gas mixture was introduced into the furnace chamber outside the insulation package, and pumped out through the dewax line connected to the bottom of the work box. There was a ⅝-inch diameter hole in the top of the work box to allow the gases in.

Three experiments were performed at 3 torr pressure. In the first, the H2 flow rate was 6.5 liters/minute, the CH4 flow rate was 1.3 liters/minute (CH4:H2 ratio 0.20). This total flow rate was the highest possible which allowed 3 torr pressure to be maintained (pumping through the dewax line). In the second, much lower flow rates and a much higher CH4:H2 ratio were used—800 cc/minute H2 and 400 cc/minute CH4 (CH4:H2 ratio 0.50). The gas treatments were for 200 minutes at 1370° C. and the cooling was at 4.0° C./minute in 1 torr argon to at least 1260° C.

In both cases the usual test inserts came to the desired enrichment level. No evidence of over-carburization of the tiny 2 gram inserts, situated at the extreme front and back of the trays, was observed.

The test inserts varied in size from ⅛ inch thickness up to ½ inch thickness and had initial carbon porosity levels ranging from C02 to C08.

The sintered parts were cross-sectioned and the enriched zones were evaluated; the data are summarized in the Table IV.

With the gentle pulsing treatment, only the ⅛ inch thick initially carbon-deficient insert came up to the required S-M/35 enrichment level.

As the pulsing became progressively more aggressive the thicker initially carbon-deficient inserts reached the required carbon level. In no case did any of the parts become over-carburized. The ultimate test was the appearance of the very small 2 gram inserts, since small inserts are more sensitive to over-carburization than are larger inserts. However, the roughening of the surface graphite layers was not observed, even in the last experiment.

Example 20

TABLE IV

CARBURIZATION OF TEST INSERTS BY PULSING WITH A H2—CH4 MIXTURE (CH4:H2 RATIO 0.25) WITH VARIOUS BACKFILL AND PUMPDOWN TIMES; 200 MINUTES AT 1370° C.; GASES DIRECTED INTO THE FURNACE CHAMBER; COOLING AT 4.0° C./MINUTE IN 1 TORR ARGON.

| FLOW RATES CC/MIN | BACKFILL TIME | PUMPDOWN TIME | S-M/35 ENRICHED ZONES ACHIEVED IN THICKNESS OF | | | |
|---|---|---|---|---|---|---|
| H2/CH4 | (SEC) | (SEC) | ⅛" | 3/16" | ¼" | ½" |
| 730/180 | 20 | 20 | YES | NO | NO | NO |
| 1400/350 | 10 | 10 | YES | YES | NO | NO |
| 2000/500 | 7 | 7 | YES | YES | YES | YES |
| 5000/1250 | 3 | 3 | YES | YES | YES | YES |
| 10000/2500 | 1 | 1 | YES | YES | YES | YES |

In the third experiment, the CH4:H2 ratio of 0.50 was maintained, but much higher flow rates were used—4.5 liters/minute H2 and 2.25 liters/minute CH4. However, it was observed that the tiny 2 gram inserts were slightly over-carburized (that is, exhibited somewhat cloudy surfaces). Thus, the combination of methane-rich mixtures and high flow rates should be avoided.

Example 19

We pulsed the gas mixture from 4 to 8 torr, with the CH4:H2 ratio fixed at 0.25. The gases entered the top of the furnace chamber outside the insulation package, and were pumped out through the roughing line situated at the bottom rear of the furnace chamber. The front and back plates of the work box had 6-by-5 arrays of ⅛-inch diameter holes, separated by approx. one inch. During the pumpdown portion of the cycle, the gas flow into the chamber was interrupted. The gas treatment was performed for 200 minutes at 1370° C. and cooling was at 4.0° C./minute in 1 torr argon to below 1260° C.

A total of five runs were performed. What was varied was the flow rates of the hydrogen and methane over very wide ranges (we were limited by the mass flowmeters and the pumping speed of the pump). The flow rates determined the backfill times. The pumpdown times were then adjusted to match the backfill time; this was an arbitrary decision.

During the treatment time of 200 minutes, the number of cycles ranged from 300 to 6000!

Another important aspect of this technique is that pre-sintered parts can be carburized to the C08 carbon porosity level, just as initially green parts can.

A number of inserts which normally sintered to C04 porosity were dewaxed for 90 minutes at the usual 420° C. then ramped to 750° C. and held for 60 minutes. Then argon was introduced to 760 torr to simulate what most sintering plants would do in pre-sintering heats of conventional grades. The parts were removed from the furnace and allowed to sit for several days so that some oxidation would occur.

Several of these inserts were then included in subsequent carburization heats. One of these involved the flowing of a H2-20% CH4 mixture (1500 cc/minute H2, 300 cc/minute CH4) at 3 torr pressure for a period of 200 minutes at 13700C. The gas mixture was introduced into the furnace chamber outside the insulation package, and entered the work box through a ⅝-inch diameter hole in the top center of the work box. The gases were pumped from the furnace through the dewax line.

The parts were cooled in 1 torr argon at 3.5° C./minute. Cross-sectioning confirmed C08 interior carbon porosity levels and S-M/35–40 enriched zones.

If parts are oxidized after pre-sintering such that they are no longer in the C-porosity region, then clearly longer carburization times, or the use of mixtures richer in methane, etc., would be required.

Example 21

FIG. 1 shows Vickers microhardness measurements taken through the enriched zone of a coated insert. A number of inserts were prepared for machining tests; one of these was used for hardness measurements. The inserts were carburized according to the technique described in Example 14, and cooled at 3.0° C./minute in 1 torr argon. They were honed, the pads were ground, and then the thin graphite and cobalt layers (approx. 2 microns each) were removed by a process utilizing electrolytic polishing as disclosed in *Metals Handbook,* 9th Ed., Vol. 9, pp.48–56, 1985, American Society for Metals. In this process, the cobalt is removed just down to the WC grains at the top of the enriched zone, and no further. The parts were then CVD coated with TiC and TiN (approx. 6 microns each).

In order to make measurements as close as possible to the top of the enriched zone, one of these inserts was ground and polished on a 10 degree angle. Hardness measurements were made on a Type M Shimadzu Micro Hardness Tester with a load of 200 grams. Three indentations (10 second dwell time) were made at each distance from the coating/substrate interface (separated laterally by at least three times the diagonals), and the readings were averaged. The microhardness increased continuously through the entire enriched zone and slowly approached a value characteristic of the interior of the part. The uncertainty in the hardness data was due to uncertainties of ±0.2 microns in the measurements of the indentation diagonals.

Figure 2:
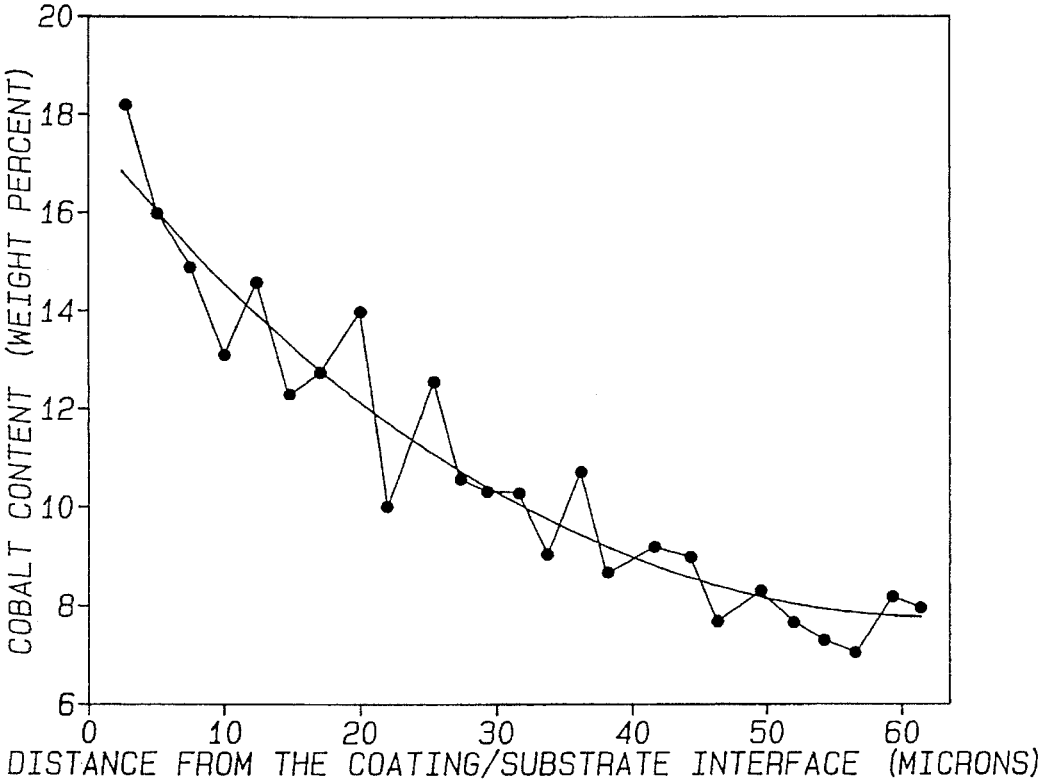
FIG. 2 is the cobalt content of a treated substrate as a function of the distance from the coating/substrate interface.

FIG. 2 shows the cobalt concentration through the enriched zone of the same insert used for the microhardness measurements. In this case the insert was cut and polished perpendicular to the enriched zone. Measurements were made by energy dispersive x-ray spectrometry with a JEOL Model 840A SEM. Data were collected simultaneously for cobalt, tungsten and titanium using a window measuring 2.5 microns by 500 microns (200X); counting was for 100 seconds at 25 kV. Unfortunately, the tantalum L and M peaks are masked by the tungsten L and M peaks, and carbon cannot be determined quantitatively by EDS. The starting position was such that the top of the window was approx. 1 micron below the coating/substrate interface; this puts the center of the window at approx. 2 microns below the interface. The window was moved at 2.5 micron increments through the enriched zone. The cobalt data were corrected using a WC-12 wt % Co standard.

The cobalt content decreased continuously through the enriched zone and approached a value characteristic of the interior. The scatter in the data was due to the nature of the stratified enrichment; that is, it was due to the presence of discrete "wavelets" of cobalt within the enriched zone.

The cobalt content approached the bulk value very slowly. This enriched zone was rated visually to be 40 microns deep, but the human eye is not nearly as sensitive to slight changes in the cobalt content as is SEM analyses.

Figure 3:
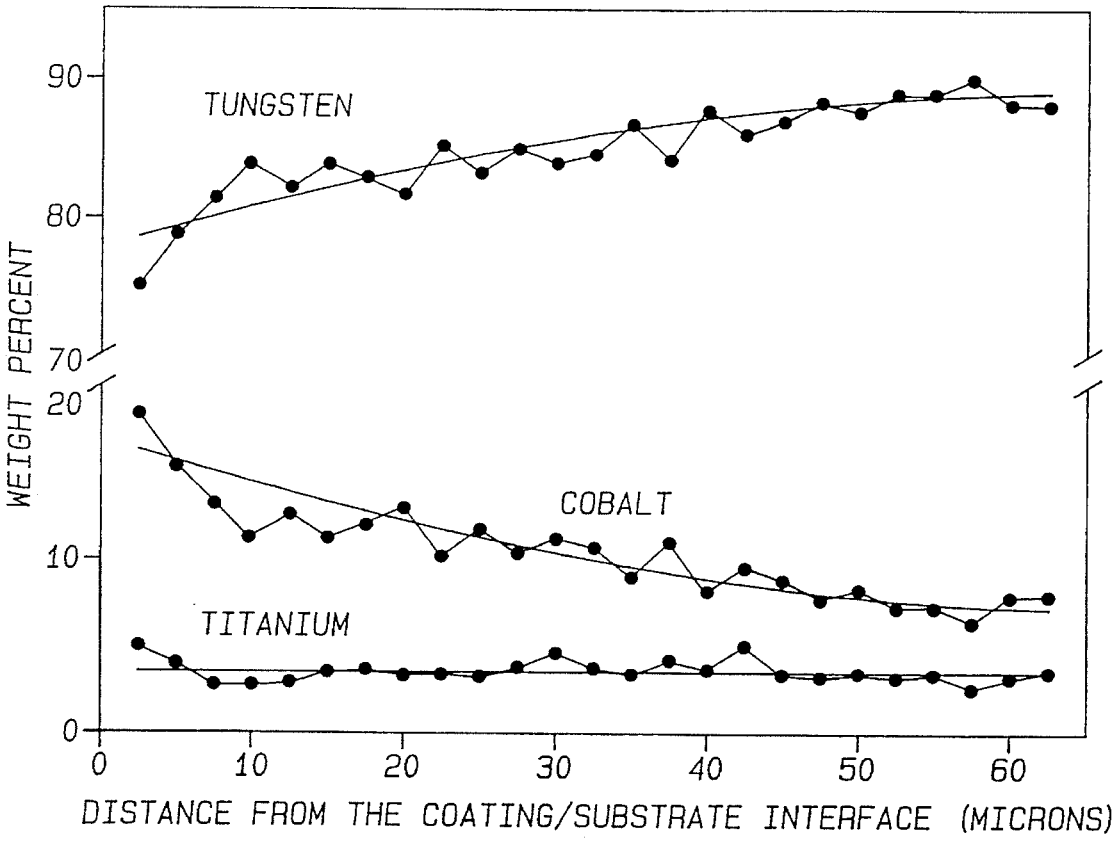
FIG. 3 is the tungsten, cobalt and titanium contents of a treated substrate as a function of the distance from the coating/substrate interface.

FIG. 3 shows the tungsten, cobalt and titanium concentrations through the enriched zone of the same insert, along with second order fits to the tungsten and cobalt data, and a first order fit to the titanium data.

This was the first time that titanium concentrations through truly stratified-only enriched zones have been reported. Although the concentration of solid solution carbide grains increased continuously through the enriched zone and approached the bulk concentration, the titanium signal was constant throughout the zone. This was very surprising.

Several interpretations are possible. The solubility of titanium in the binder could be varying through the enriched zone. Specifically, it would have to be high at the top of the enriched zone and decrease toward the bulk.

It is also possible that the concentration of carbon (not measured, as explained above) was changing dramatically through the enriched zone. Specifically, the carbon concentration would have to increase as one moved toward the surface. This interpretation is consistent with the observation that a graphite layer was observed above the enriched zone after slow cooling.

Example 22

Style CNMG 643 GR (general roughing chip breaker style) inserts (80 degree diamond, ¾ inch IC, ¼ inch thick) that were carburized according to Example 14 and cooled at 3.0° C./minute in 1 torr argon, were processed as follows. The pads were ground, and the edges were radius honed to 0.003–0.0004 inches. The cobalt layer (and the graphite layer above it) were removed by a electrolytic polishing process in which the cobalt was removed down to the WC grains at the surface, but no further. The parts were then CVD coated with TiC and TiN, approx. 6 microns each (in the same run, and all parts on the same level). Several of these inserts were subjected to machine testing.

Impact test

Operation: Fly cutting

Material: Hyten B3X (similar to 4150 steel); 270 BHN

Speed: 750 sfm

Depth of Cut: 0.125 inches

Seven tests on 100 degree corners gave an average passing feed rate, in inches per minute, of 11.8, with a standard deviation of 1.9.

Facing test

Operation: Turning

Material: 4150 steel, 260 BHN

Speed: 500 sfm

Feed: 0.015 ipr

Depth of Cut: 0.100 inches

Eight tests on 80 degree corners (the same inserts as above) gave an average tool life of 44 minutes, with a standard deviation of 5.7 minutes. The average deformation was 0.0036 inches (standard deviation 0.0004 inches).

Example 23

A wide variety of cemented carbides were successfully carburized and slow cooled so as to yield stratified enriched zones. These studies were accomplished in a smaller (Sintervac JR) furnace, using flowing H2-5% CH4 mixtures (400 cc/minute H2, 20 cc/minute CH4) at 3 torr pressure, or flowing H2-3% CH4 mixtures (2000 cc/minute H2, 60 cc/minute CH4) at 25 torr pressure, for periods of approximately 200 minutes at 1370° to 1420 20 C., followed by slow cooling in 1 torr argon to below 1260° C.

All the pressed parts measured approx. ½×½×3/16 inch. The majority of the powders were production powders, and thus would normally sinter to Ms values of approx. 135 to 155, and would not contain free carbon. But the up-take of so much carbon was not a problem for these relatively small parts during a 200-minute hold. The results are summarized in Table IV.

All the cross-sectioned parts exhibited the usual A00-B00-C00 porosity on their peripheries, to depths of 120 to 200 microns. The internal C-porosity rating was not C08 for all compositions, but depended on the binder content. This supported our contention that carburization continued until the solubility limit of carbon in the binder was reached; the higher the binder content the higher the C-porosity rating of the sintered part.

We were not able to stratify cemented carbide compositions when the binder content exceeded approx. 12 weight percent.

Grades containing TiN (beta-free grades) can be carburized to the C08 carbon porosity level, for a cobalt content of approx. 6 weight percent.

TABLE IV

C-POROSITY RATINGS AND DEPTHS OF ENRICHED ZONES AS A RESULT OF CARBURIZATION, FOLLOWED BY SLOW COOLING IN 1 TORR ARGON, OF A WIDE VARIETY OF CEMENTED CARBIDE COMPOSITIONS AND HARDNESS LEVELS.

| COMPOSITION (WEIGHT PERCENT) | HARDNESS (Ra) | C-POROSITY RATING | COOLING RATE (°C./MIN) | DEPTH OF ENRICHED ZONE (MICRONS) |
|---|---|---|---|---|
| WC-3.0 Co | 92.2 | C04/C06 | 1.4 | 30 |
| WC-6.0 Co-0.3 TaC | 91.9 | C08 | 1.5 | 60 |
| WC-6.0 Co | 93.0 | C08 | 1.5 | 40 |
| WC-10.0 Co | 92.0 | C10/C12 | 1.5 | 40 |
| WC-10.0 Co | 89.9 | C10/C12 | 1.5 | 45–50 |
| WC-6.0 Co-6.0 TaC-2.5 TiC | 91.9 | C08 | 5.0 | 25 |
| WC-6.0 Co-6.0 TaC-2.5 TiC | 92.6 | C08 | 4.5 | 20–25 |
| WC-6.0 Co-6.0 TaC 2.5 TiC | 93.3 | C08 | 4.5 | 20 |
| WC-8.5 Co-11.5 TaC-8.0 TiC | 91.4 | C10 | 1.5 | 45-50 |
| WC-7.0 Co-4.0 TaC-1.5 TiC-1.5 TiN | 91.1 | C08 | 1.5 | — |
| WC-6.0 Co-6.0 TaC-3.2 TiC-1.3 TiN | 91.9 | C08 | 1.5 | — |
| WC-6.0 Ni | 91.7 | C08 | 1.5 | 35–40 |
| WC-10.0 Ni | 90.0 | C10/C12 | 1.5 | 40–50 |

I claim:

1. A process to carburize cemented carbide substrates to the solubility limits of carbon in a binder of a cemented carbide substrate, said substrate having a wide range of thickness and initial carbon levels, said process comprising:

(a) dewaxing a green cemented carbide substrate in a vacuum furnace;

(b) slowly increasing the temperature of the furnace at a rate of about 5° to 10° C. per minute up to a sintering temperature of the cemented carbide substrate;

(c) introducing a carburizing methane gas or a carburizing gas mixture of methane and hydrogen at sub-atmospheric pressures at sintering temperatures for a time sufficient to saturate the binder with carbon in initially carbon-deficient parts of the substrate;

(d) pumping out the gas or gas mixture and introducing an inert gas from Group VIII of the periodic table;

(e) slowly cooling the furnace at a predetermined rate to below the solidus temperature of the substrate, thereby generating stratified enriched zones on the surfaces of the substrate.

2. The process of claim 1, wherein said binder is selected from the group consisting of Co, Ni, Fe and mixtures thereof.

3. The process of claim 1, wherein the inert gas is selected from the group consisting of Ar, He, and mixtures thereof.

4. The process of claim 1, wherein the substrate is comprised of WC, a binder, and a cubic carbide selected from the group consisting of TaC, NbC, TiC, and mixtures thereof.

5. The process of claim 1, wherein the thickness of the substrate is in the range of about ⅛ inch to about ½ inch.

6. The process of claim 1, wherein the initial carbon levels in the substrate range from about CO2 to about CO8 porosity.

7. The process of claim 1, wherein the carburizing gas or gas mixture is allowed to react with the cemented carbide substrates for about 0 to about 200 minutes.

8. The process of claim 1, wherein the sintering temperature is in the range of about 1,345° C. to about 1,420° C.

9. The process of claim 1, wherein flow of the carburizing gas or carburizing gas mixture is continuous.

10. The process of claim 9, wherein the gas is pure methane and the flow rate is from about 1 liter per minute to about 5 liters per minute.

11. The process of claim 9, wherein the gas is a mixture of hydrogen and methane, and the hydrogen flow rate is from about 400 cc per minute to about 15 liters per minute and the CH4 flow rate is from about 20 cc per minute to about 3 liters per minute.

12. The process of claim 1, wherein flow of the carburizing gas or gas mixture is pulsed into the furnace.

13. The process of claim 12, wherein the gas is pure methane and the flow rate is from about 1 liter per minute to about 5 liters per minute.

14. The process of claim 12, wherein the carburizing gas mixture is a mixture of hydrogen and methane, and the H2 flow rate is from about 300 cc per minute to about 10 liters per minute and the CH4 flow rate is from about 90 cc per minute to about 1.5 liters per minute.

15. The process claim 12, wherein the gas is introduced over a time range of about 1 second to about 60 seconds, and the pumping out of the gas or gas mixture takes place over a time range of from about 1 second to about 45 seconds, thereby yielding about 115 to about 600 exchanges of gas during a 200 minute hold.

16. The process of claim 1, wherein the carburization time is directly proportional to the thickness and inversely proportional to initial carbon content of the substrate.

17. The process of claim 1, wherein substrates that are not initially in free carbon can be carburized to the solubility limit of carbon in the binder by extending the carburization time, or using higher gas flows, or using higher methane contents, depending upon the size of the substrate and the specific carbon level.

18. The process of claim 16, wherein the substrate is greater than ½ inch in thickness.

19. The process of claim 1, wherein previously sintered carbon-deficient parts can be ground to dimensional tolerances, then carburized in a second sinter to the critical carbon level and slow cooled to generate stratified binder enriched zones.

20. The process of claim 1, wherein the substrate is pre-sintered, then shaped, and then subjected to the carburization process.

21. The process of claim 1, wherein the carburized parts are slow cooled in 0.5 to 2 torr argon in order to prevent the vaporization of the binder.

22. The process of claim 1, wherein the cooling rate is from about 0.5° C. per minute to about 8° C. per minute.

23. The process of claim 1, wherein the stratified enriched zone is from about 10 microns to about 100 microns in thickness.

24. The process of claim 1, wherein the substrate subjected to the carburizing gas or carburizing gas mixture has enriched zones characterized by the cobalt content decreasing from a maximum at an outer surface of the substrate and the microhardness increasing from a minimum at the outer surface of the substrate through the stratified enriched zones and approaching the values characteristic of the interior of the substrate.

25. The process of claim 1, wherein the cemented carbide substrate has a composition consisting of from about 3 to about 10 weight percent binder selected from the group consisting of Co, Ni, Fe, and mixtures thereof, from about 0 to about 11.5 weight percent cubic carbide selected from the group consisting of TaC, TiC, NbC, and mixtures thereof, and the balance WC.

26. The process of claim 25, wherein the binder is cobalt, present in an amount of about 6 weight percent, and the cubic carbide is TaC, present in an amount of about 0 to about 11.5 weight percent.

27. The process of claim 25, wherein the binder is cobalt, present in an amount of about 6 weight percent and the cubic carbide is TiC, present in an amount of about 0 to about 8 weight percent.

28. The process of claim 25, further including removing any graphite layers formed above the enriched zones and removing binder layers formed above the enriched zones just down to tungsten carbide grains positioned adjacent and beneath the graphite and binder layers at the top of the enriched zone, and then coating the substrate.

29. The process of claim 28, further including coating the substrate with TiC, TiN, TiCN, $Al_2O_3$, TiAlN, and mixtures thereof.

30. The process of claim 29, further including using the coated substrate as a cutting insert.

31. The process of claim 1 wherein the carburizing methane gas or carburizing gas mixture of methane and hydrogen is introduced at pressures of from about 1 torr up to about 30 torr.

32. The process of claim 1 wherein the cooling rate is from about 1.5° C. per minute up to about 8° C. per minute.

33. The process of claim 1 wherein the stratified enriched zone is from about 10 microns to about 60 microns in thickness.

34. A process to carburize cemented carbide substrates to the solubility limits of carbon in a binder of a cemented carbide substrate, said substrate having a wide range of thickness and initial carbon levels, said process comprising:

(a) dewaxing a green cemented carbide substrate in a vacuum furnace;

(b) slowing increasing the temperature of the furnace at a rate of about 5° to 10° C. per minute up a sintering temperature of the cemented carbide substrate;

(c) introducing a carburizing methane gas or a carburizing gas mixture of methane and hydrogen at sub-atmospheric pressures of from about 1 torr up to about 90 torr at sintering temperatures for a time sufficient to saturate the binder with carbon in initially carbon-deficient parts of the substrate;

(d) pumping out the gas or gas mixture and introducing an inert gas from Group VIII of the periodic table;

(e) slowing cooling the furnace at a predetermined rate to below the solidus temperature of the substrate, thereby generating stratified enriched zones on the surfaces of the substrate.

* * * * *